US008824934B2

(12) United States Patent
Hayashi et al.

(10) Patent No.: US 8,824,934 B2
(45) Date of Patent: Sep. 2, 2014

(54) TONER SUPPLY SYSTEM INCLUDING RECEIVING SECTION HAVING TONER STIRRER AND TONER CONTAINER ROTATBLE IN TONER SUPPLY SYSTEM

(75) Inventors: Hideji Hayashi, Okazaki (JP); Shoichiro Ishibashi, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 44 days.

(21) Appl. No.: 13/614,949

(22) Filed: Sep. 13, 2012

(65) Prior Publication Data

US 2013/0064577 A1 Mar. 14, 2013

(30) Foreign Application Priority Data

Sep. 14, 2011 (JP) ..... 2011-200075

(51) Int. Cl.
*G03G 15/08* (2006.01)

(52) U.S. Cl.
USPC ..... 399/258; 399/260

(58) Field of Classification Search
CPC ..... G03G 15/0867; G03G 15/0872
USPC ..... 399/258, 262
See application file for complete search history.

(56) References Cited

U.S. PATENT DOCUMENTS

| | | | | |
|---|---|---|---|---|
| 5,890,040 | A * | 3/1999 | Matsuoka et al. | 399/262 |
| 5,909,610 | A * | 6/1999 | Yoshiki et al. | 399/262 |
| 5,966,574 | A * | 10/1999 | Ui et al. | 399/258 |
| 6,137,972 | A * | 10/2000 | Playfair et al. | 399/106 |
| 2003/0116923 | A1 | 6/2003 | Meetze, Jr. et al. | |
| 2006/0034642 | A1 | 2/2006 | Taguchi et al. | |

FOREIGN PATENT DOCUMENTS

| | | |
|---|---|---|
| JP | 10-260574 | 9/1998 |
| JP | 11-305531 | 11/1999 |
| JP | 2000-310901 | 11/2000 |
| JP | 2003-195616 | 7/2003 |
| JP | 2004-109440 | 4/2004 |
| JP | 2006071762 | 3/2006 |
| JP | 2009-186554 | 8/2009 |

OTHER PUBLICATIONS

Notification of Reasons for Refusal mailed Nov. 5, 2013, directed to JP Application No. 2011-200075; 7 pages.

Japanese Office Action, Notification of Reasons for Refusal, Patent Application No. 2011-200075. Dispatch Date: Jun. 10, 2014 (2 pages).

English translation of Japanese Office Action, Notification of Reasons for Refusal, Patent Application No. 2011-200075. Dispatch Date: Jun. 10, 2014 (3 pages).

* cited by examiner

*Primary Examiner* — G. M. Hyder
(74) *Attorney, Agent, or Firm* — Lucas & Mercanti, LLP

(57) ABSTRACT

A toner supply system having: a receiving section that is set in a body of an image forming apparatus so as not to rotate; and a substantially cylindrical toner container that is mountable in and dismountable from the receiving section and that can be driven to rotate on an axis while being mounted in the receiving section, wherein: the toner container has a first toner feeder for feeding toner stored therein toward the receiving section while the toner container is rotated; and the receiving section has a supply port that permits toner fed thereto with rotation of the toner container to drop down and a toner stirrer that extends to a position close to the first toner feeder located inside the toner container while the toner container is mounted in the receiving section.

12 Claims, 4 Drawing Sheets

TONER SUPPLY SYSTEM INCLUDING RECEIVING SECTION HAVING TONER STIRRER AND TONER CONTAINER ROTATBLE IN TONER SUPPLY SYSTEM

This application is based on Japanese Patent Application No. 2011-200075 filed on Sep. 14, 2011, the content of which is incorporated herein by reference.

BACKGROUND OF THE INVENTION

1. Field of the Invention

The present invention relates to a toner supply system, especially a toner supply system that is suited to be provided in an image forming apparatus, such as an electrophotographic copying machine or printer, for supplying toner to the apparatus, and relates to a toner container used for the toner supply system.

2. Description of Related Art

Generally in an electrophotographic image forming apparatus, for the purpose of replenishing toner consumed for image formation, a toner supply system is provided. With the toner supply system, a toner container stored with toner is detachably mounted in an apparatus body, and an appropriate amount of toner is supplied from the toner container to the apparatus body. It is to be noted that the toner supplied by this toner supply system is further measured and adjusted so that an amount of toner consistent with a consumed amount can be supplied to a development device.

This kind of toner container is mountable in and dismountable from a receiving section in the apparatus body. The toner container is substantially in the shape of a cylinder, and while the toner container is mounted in the receiving section, it can be rotated on the axis of the cylinder. On the inner wall of the cylindrical toner container, a spiral convex or fin is formed, and as the toner container is rotated, the spiral convex or fin serves to feed toner to a toner supply port made in the receiving section. The toner container has no choice but to have a smaller supply-side opening than the outer diameter of the toner container for the reason of spatial restriction. Therefore, there is an upslope or a step in the vicinity of the supply-side opening, which is an obstacle to the toner feed.

Meanwhile, there has recently been a tendency to use low-melting-point toner. As the low-melting-point toner is stored under high temperature, the fluidity thereof becomes low. When the toner container stored with low-fluidity toner is mounted in the receiving section, even the function of the spiral convex or fin as a feeder cannot satisfactorily resolves stagnation of toner in the vicinity of the supply-side opening, where the toner feed is inhibited. This makes it difficult to ensure a toner supply be conducted satisfactorily.

There have been proposed a toner supply apparatus and a toner bottle described in Japanese Patent No. 4423140 and Japanese Patent Laid-Open Publication No. 1111-305531 for resolving stagnation of toner, but those have not necessarily exerted sufficient effects.

SUMMARY OF THE INVENTION

A first aspect of the present invention provides a toner supply system comprising: a receiving section that is set in a body of an image forming apparatus so as not to rotate; and a substantially cylindrical toner container that is mountable in and dismountable from the receiving section and that can be driven to rotate on an axis while being mounted in the receiving section, wherein: the toner container has a first toner feeder for feeding toner stored therein toward the receiving section while the toner container is rotated; and the receiving section has a supply port that permits the toner fed thereto with rotation of the toner container to drop down and a toner stirrer that extends to a position close to the first toner feeder located inside the toner container while the toner container is mounted in the receiving section.

A second aspect of the present invention provides a substantially cylindrical toner container that is mountable in and dismountable from a receiving section set in a body of an image forming apparatus so as not to rotate and that can be driven to rotate on an axis while being mounted in the receiving section, and the toner container comprises: a first toner feeder for feeding toner stored in the toner container toward the receiving section while the toner container is rotated; wherein one end of the first toner feeder is located in a position close to a toner stirrer provided in the receiving section.

BRIEF DESCRIPTION OF THE DRAWINGS

These and other features of the present invention will be apparent from the following description with reference to the accompanying drawings, in which.

DETAILED DESCRIPTION OF PREFERRED EMBODIMENTS

Hereinafter, toner supply systems and toner containers according to embodiments of the present invention will be described with reference to the accompanying drawings.

First Embodiment; See FIGS. 1 to 3

Figure 1:
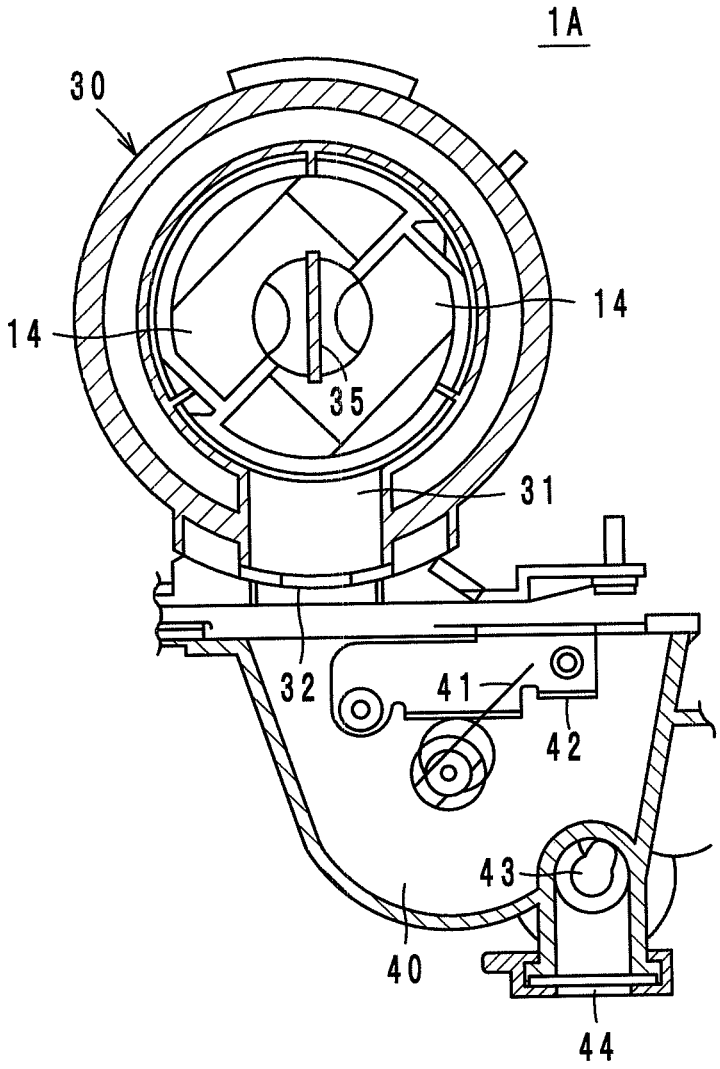
FIG. 1 is a cross-sectional view in the vertical direction of a toner supply system according to a first embodiment.
Figure 2:
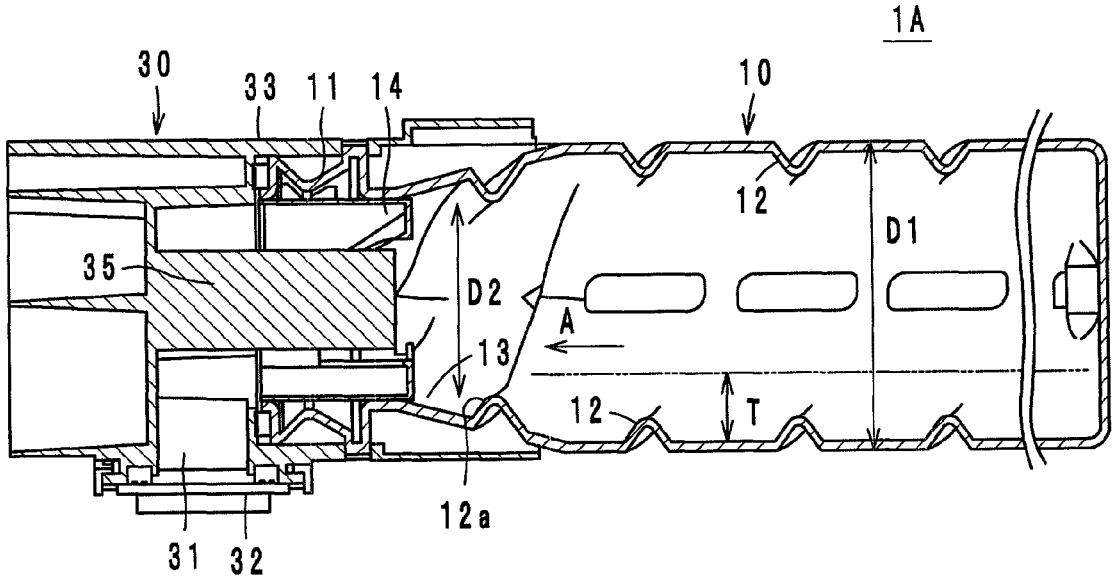
FIG. 2 is a longitudinal sectional view in the vertical direction of the toner supply system according to the first embodiment.
Figure 3:
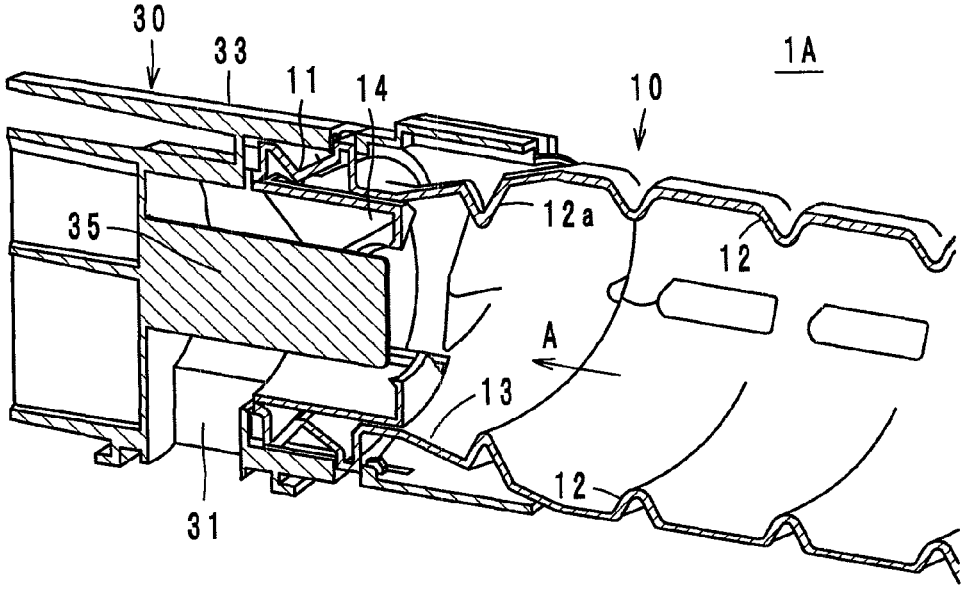
FIG. 3 is a perspective view of a main part of the toner supply system according to the first embodiment.

As shown in FIGS. 1 and 2, a toner supply system 1A according to a first embodiment includes a toner container 10 and a receiving section 30 that holds an open end 11 of the toner container 10. The receiving section 30 is fixed to a body of an image forming apparatus (not shown) so as not to rotate. The receiving section 30 has a supply port 31 that permits toner to drop to a reservoir section 40 located below, a shutter 32 that closes the supply port 31, and a toner stirrer 35. It is to be noted that the components of the receiving section 30 other than the toner stirrer 35, which will be detailed later, are known.

The reservoir section 40 is installed with a stirring blade 41, a toner measuring section 42 and a toner feeding screw 43. Toner supplied to the reservoir section 40 through the supply port 31 is fed to a supply port 44 by the screw 43, and further, toner in an amount to compensate for toner consumed for image formation is supplied to a development device (not shown).

The toner container 10 is substantially of a long cylindrical shape and is made of resin. A spiral convex 12 is formed on an inner wall of a body of the container 10, and as the body of the container 10 is rotated on its axis, toner, which is pooled at the bottom of the container 10 with a layer thickness T shown in FIG. 2, is fed to the open end 11. In this moment, the spiral convex 12 functions as a first toner feeder. Although not shown, as the mechanism to rotate the toner container 10, a conventionally known mechanism is used.

The body of the toner container 10 has a predetermined outer diameter D1, and the end 11 of the container 10 has an inner diameter D2 smaller than the outer diameter D1. In the end portion 11 of the container 10, a sloping surface 13 rises as going forward in a toner feeding direction (see arrow A), which inhibits the spiral convex 12 from feeding toner. In order to facilitate the toner feed, on an inner wall of the open end 11, a sloping surface 14 that serves to feed toner to the supply port 31 is formed between the supply port 31 and a convex section 12*a* on the leftmost side in FIGS. 2 and 3. Thus, the sloping surface 14 functions as a second toner feeder that feeds the toner, which has been fed to the sloping surface 13 with rotation of the container 10, further to the supply port 31. This sloping surface 14 is arranged to be divided into two parts on a vertical plane as shown in FIG. 1.

While the toner container 10 stored with toner rests under high temperature, the fluidity of the toner lowers. This tendency is especially true of a case of using low-melting-point toner. In such a case, a certain part of toner on the sloping surface 13 is fed to the supply port 31 by the sloping surface 14 (second toner feeder), but the toner feed by the sloping surface 14 is not sufficient. Therefore, in the first embodiment of the present invention, the receiving section 30 is provided with the toner stirrer 35 extending from its rear end to a position close to the spiral convex 12 (first toner feeder). The toner stirrer 35 is a rectangular plate made of resin having rigidity, and the plate is supported vertically in a cantilever state by the rear end surface of the receiving section 30.

In the toner supply system 1A of the configuration above, the open end 11 of the toner container 10 is fitted in a tube 33 of the receiving section 30, whereby the container 10 is rotatably mounted in the receiving section 30 and is connected to the rotary drive mechanism (not shown). Also, the end 11 of the container 10 presses the shutter 32 in a direction shown by arrow A, to open up the supply port 31. Thereafter, while the container 10 is being rotated, toner stored in its bottom is fed in the direction shown by arrow A and passes over the sloping surfaces 13 and 14. Then, the toner is dropped and supplied to the reservoir section 40 through the supply port 31. At this time, even if toner is solidified and stagnated on the sloping surfaces 13 and 14, the stirrer 35 collapses the stagnated toner with the rotation of the container 10, thereby generating a flow of the toner. Thus, a toner feed to the supply port 31 is ensured.

It should be noted that the first toner feeder is not necessarily the spiral convex 12, and the first toner feeder may be a spiral fin. Alternatively, the first toner feeder may be a rotary body that can rotate together with the container 10, for example, a screw-like rotary body formed separately from the container 10. Further, the toner stirrer 35 may be somewhat flexible.

Second Embodiment; See FIGS. 4 and 5

Figure 4:
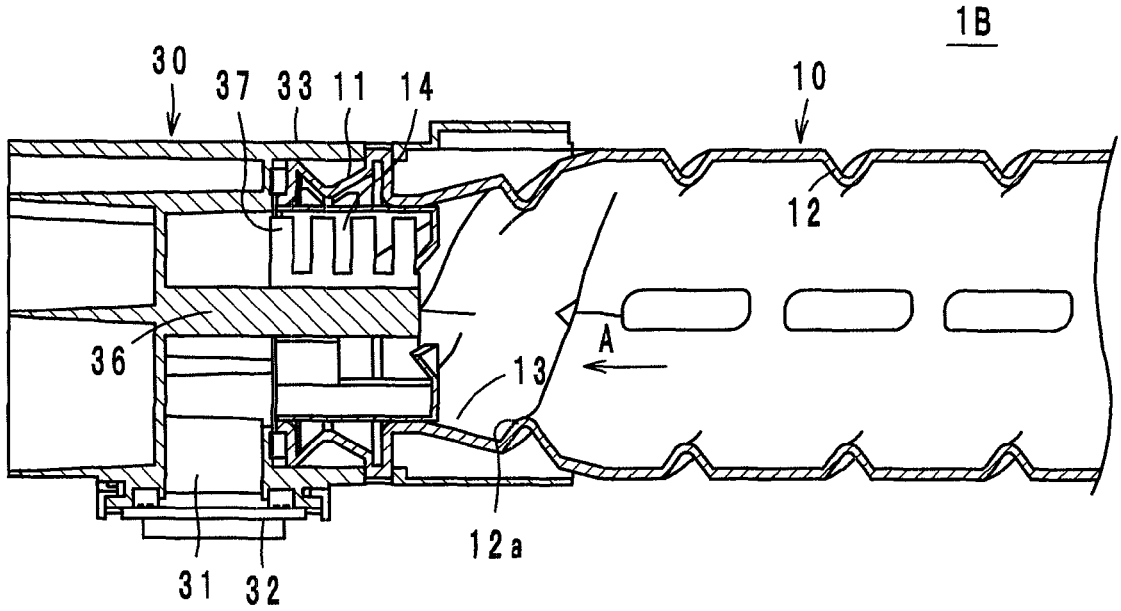
FIG. 4 is a longitudinal sectional view in the vertical direction of a toner supply system according to a second embodiment.
Figure 5:
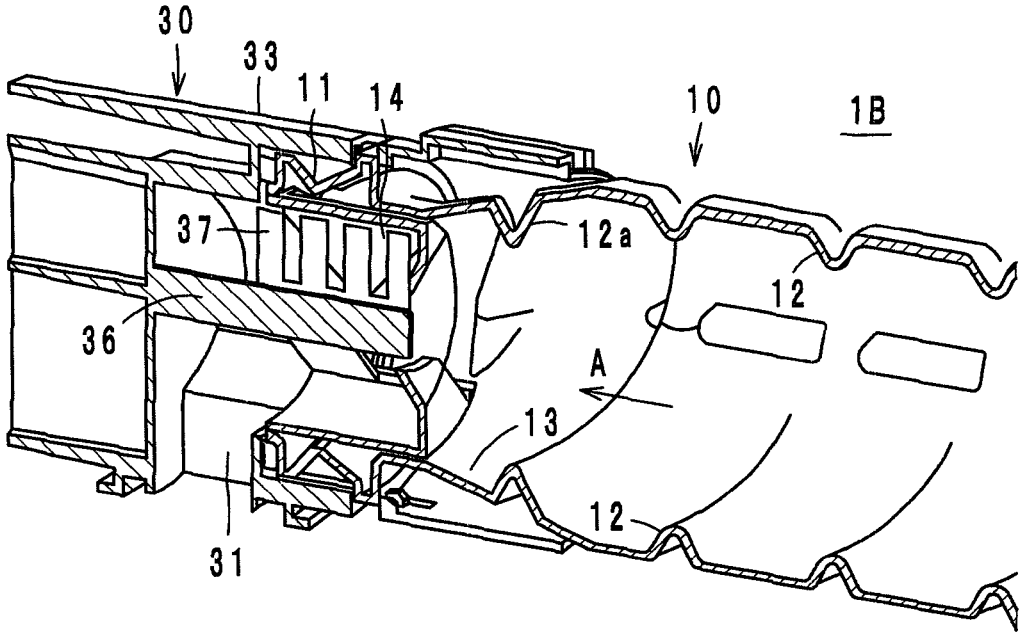
FIG. 5 is a perspective view of a main part of the toner supply system according to the second embodiment.

As shown in FIGS. 4 and 5, a toner supply system 1B according to a second embodiment has a toner stirrer 36 instead of the toner stirrer 35 used in the first embodiment above. The toner stirrer 36 has a width a little smaller than that of the toner stirrer 35, and a flexible resin film 37 is attached to the toner stirrer 36. Except for these points, the configuration of the second embodiment is similar to that of the first embodiment. As the toner container 10 is rotating, the resin film 37 rubs its tip against the sloping surface 14 to stir toner adhering to the sloping surface 14. This leads to more effective stirring of stagnated toner. Thus, the resin film 37 functions as an auxiliary stirrer. As shown in FIGS. 4 and 5, the film 37 is preferably divided into a plurality of parts, and the film 37 preferably rubs its tip against the sloping surface 14. It is also preferred that the film 37 is arranged on the opposite side to the supply port 31. With respect to the material for the film 37, so long as it has flexibility, there are no other particular requirements.

Third Embodiment; See FIG. 6

Figure 6:
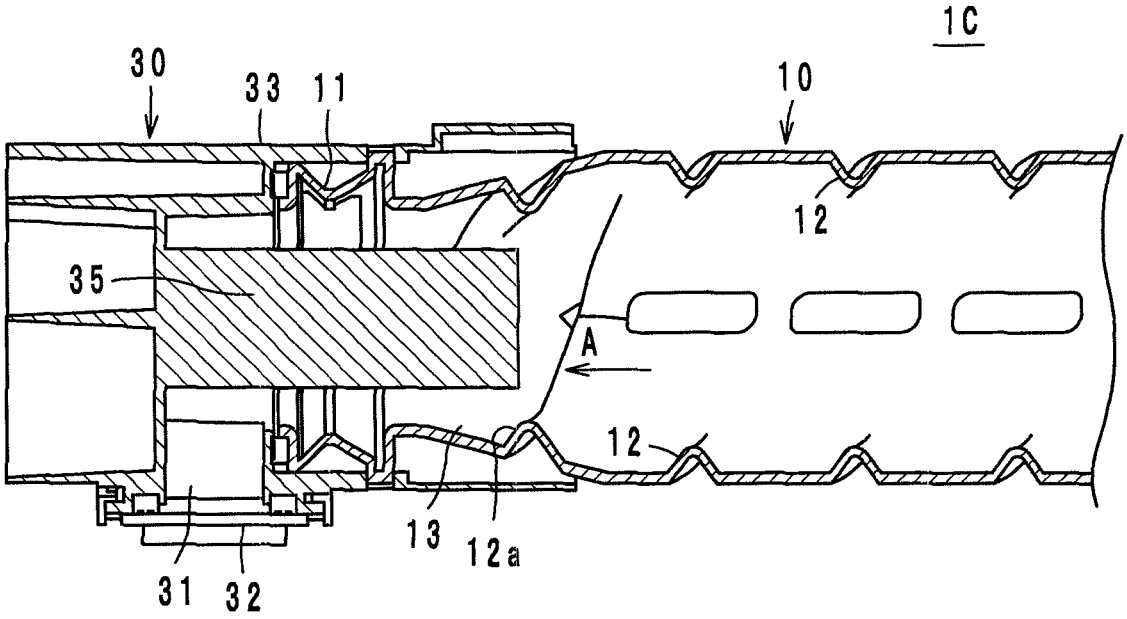
FIG. 6 is a longitudinal sectional view in the vertical direction of a toner supply system according to a third embodiment.

As shown in FIG. 6, a toner supply system 1C according to a third embodiment does not comprise the sloping surface 14 that functions as a second toner feeder. Except for this point, the configuration of the third embodiment is similar to that of the first embodiment. Even without the sloping surface 14, because the toner stirrer 35 extends to the vicinity of the convex section 12*a*, which is the part of the spiral convex 12 closest to the open end 11, it is possible to resolve stagnation of toner, thereby ensuring good toner feeding performance.

Other Embodiments

It should be noted that the toner supply system and the toner container according to the present invention are not restricted to the above embodiments. Especially with respect to the toner container and the receiving section, the details of the configurations and the shapes thereof can be arbitrarily designed. Also, the drive mechanism for rotating the toner container can be arbitrarily designed.

Although the present invention has been described in connection with the preferred embodiments above, it is to be noted that various changes and modifications are possible for those who are skilled in the art. Such changes and modifications are to be understood as being within the scope of the present invention.

What is claimed is:

1. A toner supply system, comprising:

a receiving section that is set in a body of an image forming apparatus so as not to rotate; and a substantially cylindrical toner container that is mountable in and dismountable from the receiving section and that can be driven to rotate on an axis while being mounted in the receiving section, wherein:

the toner container has a first toner feeder for feeding toner stored therein toward the receiving section while the toner container is rotated;

the receiving section has a supply port that permits the toner, fed thereto with rotation of the toner container, to drop down and a toner stirrer that extends to a position close to the first toner feeder located inside the toner container while the toner container is mounted in the receiving section; and one end of the toner stirrer is fixed to the receiving section which does not rotate.

2. The toner supply system according to claim 1, wherein the first toner feeder is a spiral convex or fin formed on an inner wall of the toner container.

3. The toner supply system according to claim 1, wherein the first toner feeder rotates along with rotation of the toner container.

4. The toner supply system according to claim 1, wherein the toner stirrer is provided with an auxiliary stirrer having flexibility.

5. The toner supply system according to claim 4, wherein the auxiliary stirrer is divided into a. plurality of parts.

6. The toner supply system according to claim 4, wherein, the auxiliary stirrer is arranged on the opposite side to the supply port with respect to a rotational axis of the toner container.

7. The toner supply system according to claim 1, further comprising: a second toner feeder, which is located between the first toner feeder and the receiving section, for feeding the toner stored in the toner container toward the supply port while the toner container is rotated.

8. The toner supply system according to claim 7, wherein: the toner stirrer is provided with at auxiliary stirrer having flexibility; and the auxiliary stirrer rubs its tip against the second toner feeder.

9. A combination of a toner receiving section and a substantially cylindrical toner container that is mountable in and dismoutable from the receiving section set in a body of an image forming apparatus so as not to rotate and that can be driven to rotate on an axis while being mounted in the receiving section, the combination comprising:

a first toner feeder for feeding toner stored in the toner container toward the receiving section while the toner container is rotated, wherein one end of the first toner feeder is located in a position close to a toner stirrer provided in the receiving section: and one end of the toner stirrer is fixed to the receiving section which does not rotate.

10. The combination according to claim 9, wherein the first toner feeder is a spiral convex or fin formed on an inner wall of a container body.

11. The combination according to claim 9, wherein the first toner feeder rotates along with rotation of the container body.

12. The combination according to claim 9, comprising:

a second toner feeder , which is located between the first toner feeder and a supply port made in the receiving section to permit toner to drop down, for feeding the toner stored in the toner container toward the supply port while the toner container is rotated.

* * * * *